US007727131B2

(12) United States Patent
Longo

(10) Patent No.: US 7,727,131 B2
(45) Date of Patent: Jun. 1, 2010

(54) LINKED STRETCH TUBING

(75) Inventor: Brett J. Longo, 27075 Sunningdale Way, Valley Center, CA (US) 92082

(73) Assignee: Brett J. Longo, Valley Center, CA (US)

( * ) Notice: Subject to any disclaimer, the term of this patent is extended or adjusted under 35 U.S.C. 154(b) by 383 days.

(21) Appl. No.: 11/372,519

(22) Filed: Mar. 10, 2006

(65) Prior Publication Data

US 2007/0213186 A1 Sep. 13, 2007

(51) Int. Cl.
*A63B 21/02* (2006.01)

(52) U.S. Cl. ..... 482/124; 482/121

(58) Field of Classification Search ..... 482/121, 482/122, 124, 126, 129, 130; 119/769, 770
See application file for complete search history.

(56) References Cited

U.S. PATENT DOCUMENTS 1,703,375 A * 2/1929 Volk ..... 473/216
2,848,234 A * 8/1958 Brandon ..... 473/229
2,893,736 A 7/1959 Tesi
3,429,571 A 2/1969 Abel, Jr.
3,462,156 A * 8/1969 Gentry ..... 473/229
3,769,939 A 11/1973 Wais et al.
3,870,317 A * 3/1975 Wilson ..... 473/216
3,940,144 A * 2/1976 Dickie ..... 473/215
4,073,490 A 2/1978 Feather
4,134,589 A 1/1979 Arena
4,544,155 A * 10/1985 Wallenbrock et al. ..... 482/129
4,955,608 A 9/1990 Dougherty et al.
5,009,420 A 4/1991 Martelli
5,188,366 A 2/1993 Dorotinsky et al.
5,308,074 A 5/1994 Dorotinsky et al.
5,351,654 A * 10/1994 Fuentes ..... 119/770
5,358,250 A 10/1994 Spencer
5,518,481 A 5/1996 Darkwah
5,626,544 A * 5/1997 Foresto ..... 482/124
5,672,115 A 9/1997 Sanchez
5,806,466 A * 9/1998 Pintor et al. ..... 119/770
5,813,955 A * 9/1998 Gutkowski et al. ..... 482/124
5,842,956 A 12/1998 Strachan
5,924,933 A * 7/1999 Pacheco ..... 473/216
5,993,362 A * 11/1999 Ghobadi ..... 482/124
6,012,993 A * 1/2000 Guerriero ..... 473/424
6,048,281 A 4/2000 Place et al.
6,120,418 A * 9/2000 Plough ..... 482/69
6,238,324 B1 * 5/2001 MacMillan ..... 482/121
6,261,212 B1 7/2001 Vallone et al.
6,322,483 B1 * 11/2001 Rotella ..... 482/129
6,558,302 B2 * 5/2003 Cluff ..... 482/129
6,726,606 B2 4/2004 Jacobsen
7,153,245 B2 * 12/2006 Kim ..... 482/121

(Continued)

*Primary Examiner*—Fenn C Mathew
*Assistant Examiner*—Andrew M Tecco
(74) *Attorney, Agent, or Firm*—Bernard L. Kleinke; Duckor Spradling Metzger & Wynne

(57) ABSTRACT

A method and system are disclosed. The system may include a linked stretch tube. The linked stretch tube may include a first stretch tubing section having a first end and a second end; a second stretch tubing section having a first end and a second end; a first linking device permanently, flexibly connecting the first end of the first stretch tubing section to the first end of the second tubing section; and a first connection device flexibly connected to the second end of the first stretch tubing section.

8 Claims, 3 Drawing Sheets

U.S. PATENT DOCUMENTS

| | | | | |
|---|---|---|---|---|
| 7,314,437 | B2 * | 1/2008 | Frappier | 482/124 |
| 2002/0068667 | A1 * | 6/2002 | Strachan | 482/124 |
| 2003/0130098 | A1 * | 7/2003 | Marco | 482/124 |
| 2003/0153440 | A1 | 8/2003 | Kim | |
| 2003/0158024 | A1 * | 8/2003 | Saure | 482/126 |

* cited by examiner

LINKED STRETCH TUBING

BACKGROUND OF THE INVENTION

1. Field of the Invention

The present invention relates in general to stretch tubing. It more particularly relates to a method and system for linked stretch tubing for use in exercising, sports conditioning, or physical rehabilitation.

2. Background Art

There is no admission that the background art disclosed in this section legally constitutes prior art.

There have been a variety of exercise devices employing stretch tubing for various exercises or for conditioning for specific sports. For example, reference may be made to U.S. Pat. Nos. 4,073,490; 4,544,155; 4,955,608; 5,518,481; 5,842,956; 6,261,212; and 6,726,606.

Exercising using stretch cords is a convenient technique for obtaining an effective exercise, and may eliminate the need for bulky weights. However, a large number of stretch cords may be necessary to perform all the desired exercises. Stretch cords come in a variety of lengths and resistances. Common lengths for stretch cord are 1.5, 2, 3, 4, and 7 feet in length. Typically, ten or more resistance levels are available ranging from 0.3-1.5 pounds of pull to 20-45 pounds of pull. The length of the stretch cord may depend on the type of exercise, the body part being exercised, and the size of the person performing the exercise. The resistance level of the stretch cord may depend on the body party being exercised and the strength of the person. Since some exercises require resistance on multiple parts or sides of the body, multiple stretch cords of the same length and resistance level may be required. Therefore, to accomplish all the desired exercises a person may need a large number such as fifty or more stretch cords.

BRIEF DESCRIPTION OF THE DRAWINGS

The features of this invention and the manner of attaining them will become apparent, and the invention itself will be best understood by reference to the following description of certain embodiments of the invention taken in conjunction with the accompanying drawings, wherein.

DESCRIPTION OF CERTAIN EMBODIMENTS OF THE INVENTION

Figure 1:
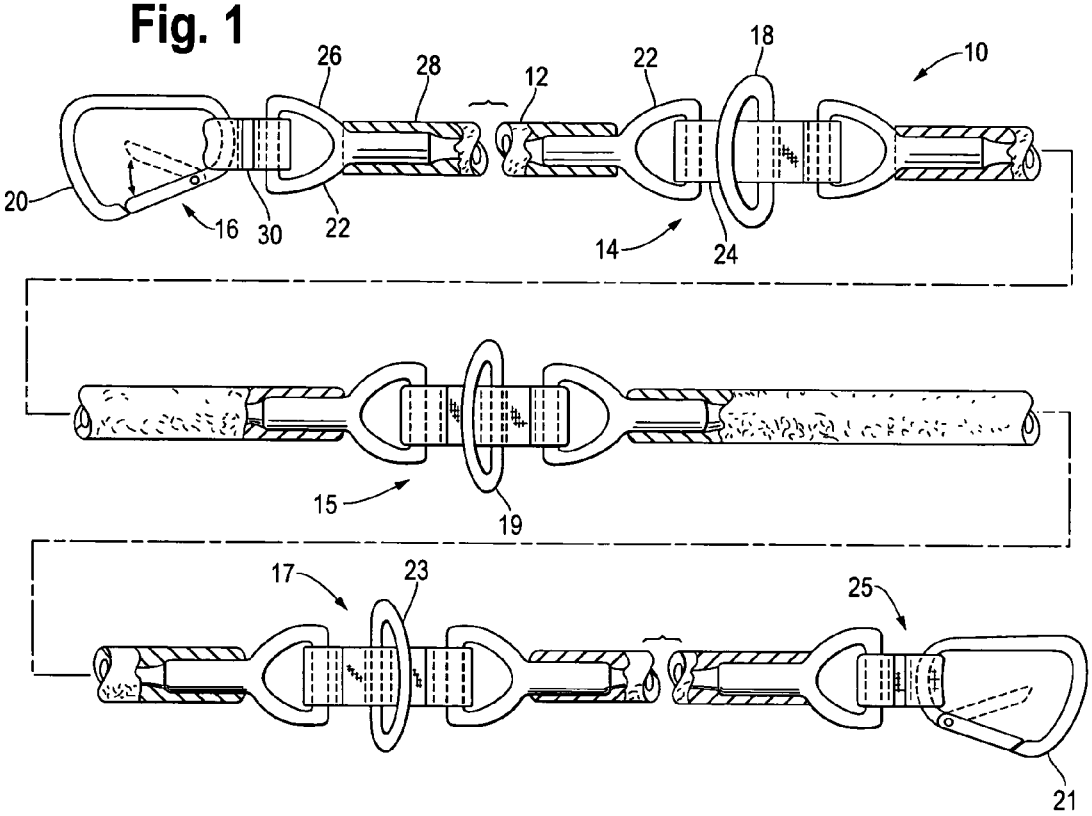
FIG. 1 is a partial sectional view of an embodiment of a linked stretch tube of the present invention.

It will be readily understood that the components of the embodiments as generally described and illustrated in the drawings herein, could be arranged and designed in a wide variety of different configurations. Thus, the following more detailed description of the embodiments of the system, components and method of the present invention, as represented in the drawings, is not intended to limit the scope of the invention, as claimed, but is merely representative of the embodiments of the invention.

A method and system are disclosed, and may include a linked stretch cord or tube. The linked stretch tube may include a first stretch tubing section having a first end and a second end; a second stretch tubing section having a first end and a second end; a first linking device fixedly, flexibly connecting the first end of the first stretch tubing section to the first end of the second tubing section; and a first connection device flexibly connected to the second end of the first stretch tubing section.

In accordance with another disclosed embodiment of the invention, there is provided an exercising system, which may include a plurality of linked stretch tubes, a waist harness adapted to attach to the linked stretch tubes, and at least one foot harness adapted to attach to the linked stretch tubes.

According to another aspect of a disclosed embodiment of the invention, there is provided a method of exercising using a linked stretch tube having a two stretch tube sections with a fastener on each end of the linked stretch tube and a metal ring attached between the two stretch tube sections. The method may include attaching both fasteners to a first exercise accessory and attaching the metal ring to a second exercise accessory.

According to yet another aspect of a disclosed embodiment of the present invention, there is provided a method of exercising using a linked stretch tube having at least three stretch tube sections with a fastener on each end of the linked stretch tube and a rigid ring attached each link between two stretch tube sections. The method may include attaching one of the fasteners to a first exercise accessory and attaching one of the rings to a second exercise accessory.

According to still another aspect of a disclosed embodiment of the present invention, there is provided a method of exercising by a user wearing a waist harness and a pair of foot harnesses. The method may include attaching a first stretch cord between a first side of the waist harness and one side of the foot harnesses and attaching a second stretch cord between a second side of the waist harness and the other foot harness.

Figure 2:
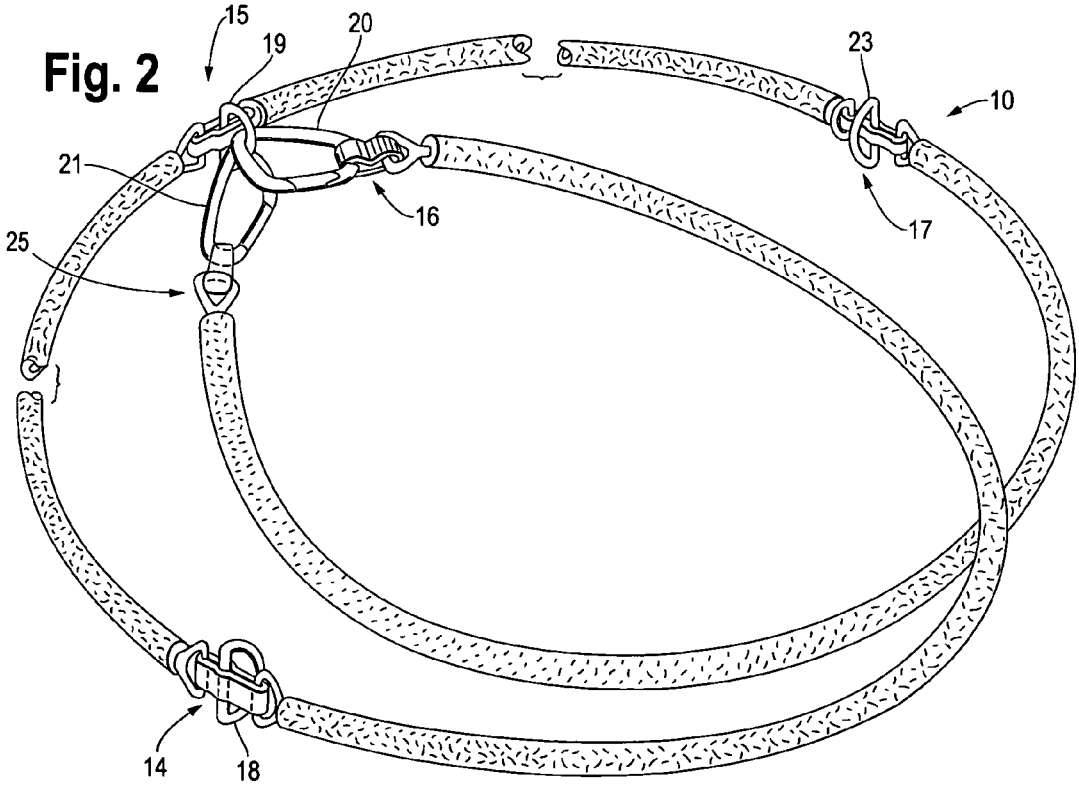
FIG. 2 is a perspective view of the linked stretch tube of FIG. 1 being illustrated to increase the resistance of the linked stretch tube.

Referring to FIGS. 1 and 2, an embodiment of the present invention as a linked stretch tube is shown. The linked stretch tube 10 may included a plurality of stretch tubing sections such as a stretch tubing sections 12, a series of linking devices 14, 15 and 17 permanently and flexibly joining the stretch tubing sections such as the section 12, and a pair of connection devices 16 and 25 at each end of the linked stretch tube 10. The number of stretch tubing sections may typically be three or four, but a linked stretch tube may include two sections or more than four sections depending on the application. The length of each stretch tubing section such as the section 12 may vary, and may typically be about twelve or about eighteen inches in length, but sections shorter or longer may also be useful depending on the application. The stretch tubing sections such as this section 12 may also be available in a variety of different resistance levels.

Each linking device such as the device 14 may include a rigid ring such as a metal ring 18 for connecting to exercise accessories, such as a waist harness, a foot harness, a handle, a wall mount or a door mount, for decreasing the useful or effective used length of the linked stretch tube 10, as hereinafter described in greater detail. Each connection device such as the device 16 may include a fastener or carabiner 20 for connecting to the exercise accessories or to one of the metal rings 18 to increase the resistance in a section of the linked stretch tube 10. In FIG. 2, both connection devices 16 and 25 of the linked stretch tube 10 are attached to the same metal ring 19 of the center linking device 15. In this configuration the usable length of the linked stretch tube 10 may reduce to about one half of the length of the linked stretch tube 10 in FIG. 1, and the resistance may be twice the resistance of the linked stretch tube 10 in FIG. 1. In this configuration the linked stretch tube 10 may be attached to exercise accessories using the rings 18 and 23. The ability to adjust the length and the resistance of the linked stretch tube 10 may allow an exerciser utilizing stretch tubing fewer pieces of stretch tubing.

Figure 4:
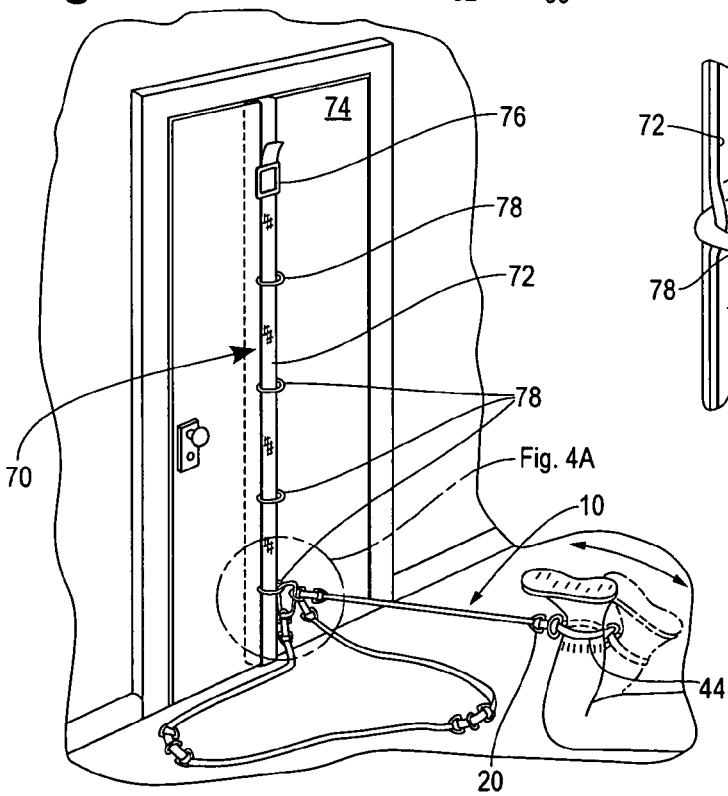
FIG. 4 is a perspective view of an exercise system using linked stretch tubing attached to a door.
Figure 4A:
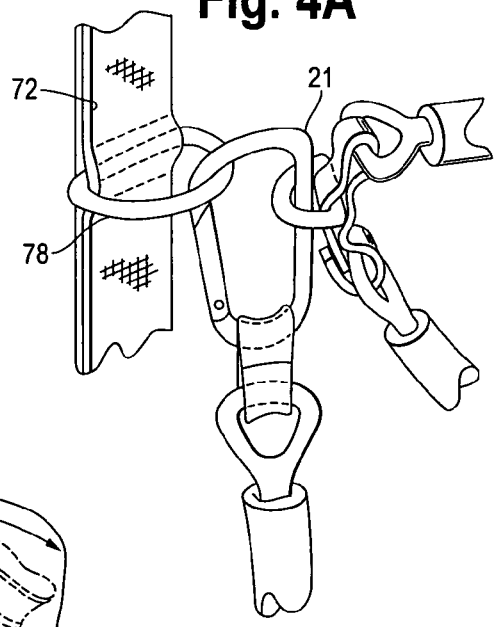
FIG. 4A is an enlarged view of the linked stretch tube attached to a door strap of FIG. 4.
Figure 5:
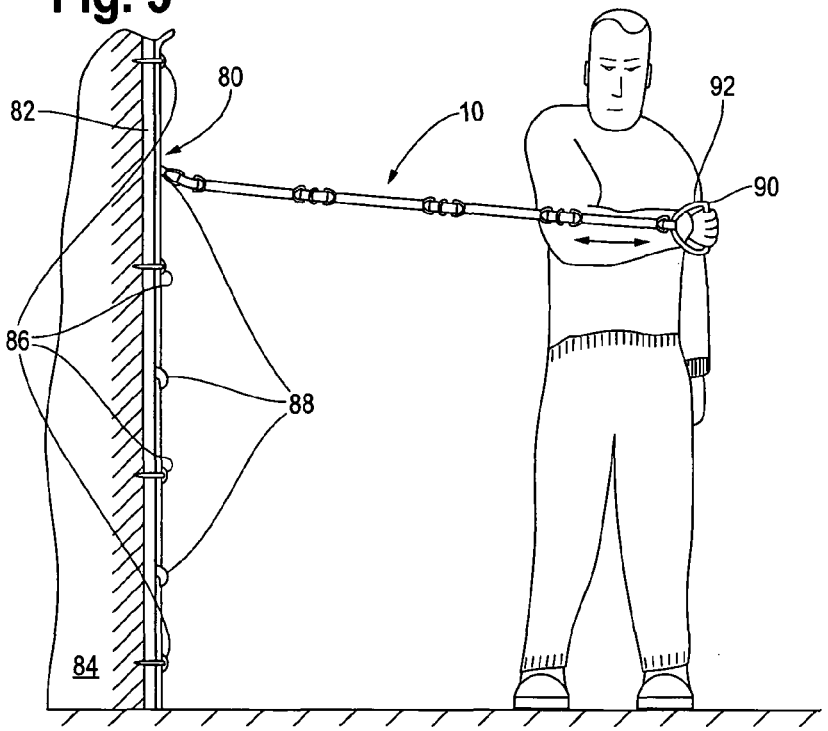
FIG. 5 is a perspective view of an exercise system using linked stretch tubing attached to a wall.

The effective or usable length of the linked stretch tube 10 having four stretch tubing sections may be adjusted to four different lengths. With the desired resistance of the usable length of the linked stretch tube equal to the resistance in one of the stretch tubing sections, the usable length of the linked stretch tube 10 may be adjusted to about one quarter of the length of the linked stretch tube 10 by attaching the carabiner 20 to a first exercise accessory, such as a foot harness, and by attaching the ring 18 to a second exercise accessory, such as a door strap, using the carabiner 21 as shown in FIGS. 4 and 4A. A separate carabiner (not shown) may be used in place of the carabiner 21 to attach the ring 18 to the second exercise accessory. To increase the usable length of the linked stretch tube 10 to about one half of the length of the linked stretch tube 10, the ring 19 may be attached to the second exercise accessory instead of attaching the ring 18 to the second exercise accessory. Likewise to increase the usable length of the linked stretch tube 10 to about three quarters of the length of the linked stretch tube 10, the ring 23 may be attached to the second exercise accessory instead of attaching either of the rings 18 and 19 to the second exercise accessory. The total length of the linked stretch tube may be utilized by attaching the carabiner 20 to the first exercise accessory and attaching the carabiner 21 to the second exercise accessory as shown in FIG. 5.

The resistance of the linked stretch tube 10 having four stretch tubing sections may be adjusted to a plurality of different resistances depending on the desired usable or effective length of the linked stretch tube 10. The configurations of the linked stretch tube 10 having a resistance equal to the resistance of one of the stretch tubing sections have been described above regarding the four different lengths.

Figure 7:
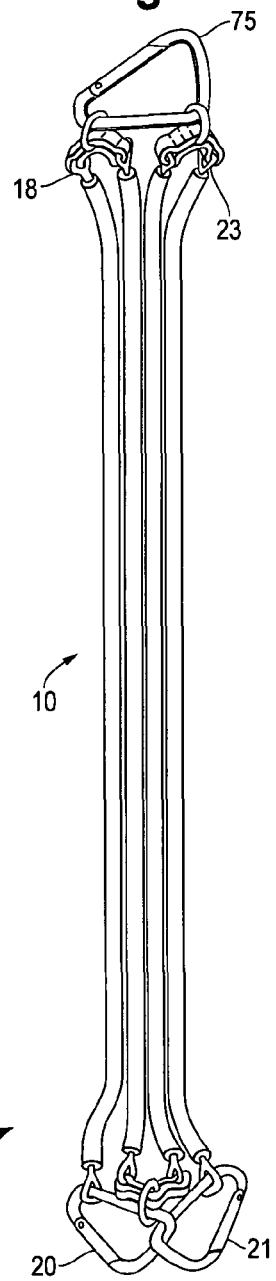
FIG. 7 is a perspective view of the linked stretch tube of FIG. 1 being illustrated to approximately quadruple the resistance of the linked stretch tube when attached to a pair of exercise accessories.

With the desired usable or effective length of the linked stretch tube 10 equal to about one quarter of the length of the linked stretch tube 10, the resistance of the linked stretch tube 10 may be adjusted to three additional resistances. To approximately double the resistance of the linked stretch tube 10 with the carabiner 20 attached to the first exercise accessory and the ring 18 attached to the second exercise accessory using either carabiner 21 or a separate carabiner, the ring 19 may be attached to the carabiner 20 at the first exercise accessory. Furthermore to increase the resistance from approximately double to approximately triple the resistance of the linked stretch tube 10, the ring 23 may be attached with the ring 18 to the second exercise accessory using the carabiner 21 or a separate carabiner. To increase the resistance from approximately triple to approximately quadruple the resistance of the linked stretch tube 10, the carabiner 21 may be attached with the carabiner 20 and the ring 19 at the first exercise accessory, such as a foot harness, and the rings 18 and 23 may be attached to the second exercise accessory, such as a door strap, using a separate carabiner 75 as shown in FIG. 7.

Figure 3:
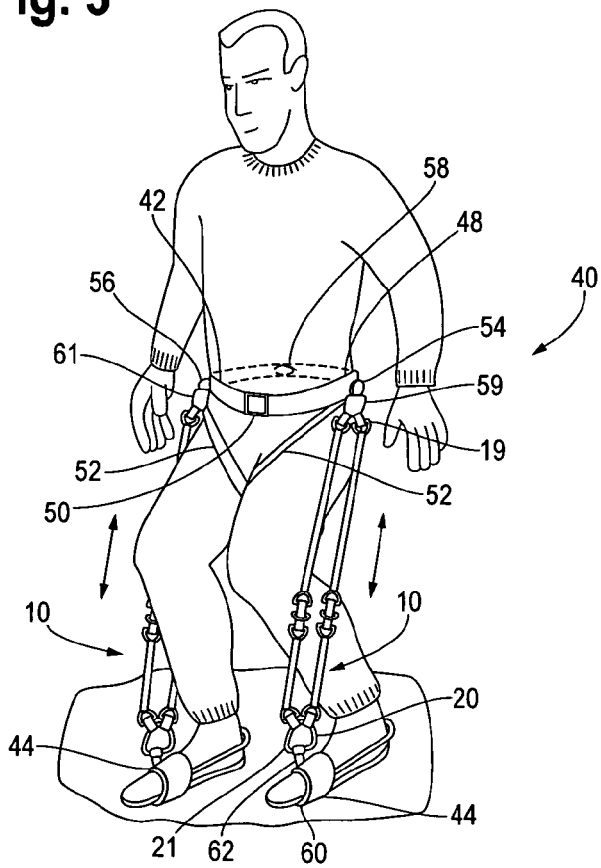
FIG. 3 is a perspective view of an exercise system using a waist harness, foot harnesses, and linked stretch tubing.

With the desired usable or effective length of the linked stretch tube 10 equal to about one half of the length of the linked stretch tube 10, the resistance of the linked stretch tube 10 may be adjusted to two additional resistances. To approximately double the resistance of the linked stretch tube 10 over the entire one half length of the linked stretch tube 10 with the carabiner 20 attached to the first exercise accessory and the ring 19 attached to the second exercise accessory using a separate carabiner, the carabiner 21 may be attached to the first exercise accessory along with the carabiner 20 as shown in FIG. 3. Another configuration of the linked stretch tube 10 to approximately double the resistance at about one half the length of the linked stretch tube 10 may be to attach both the carabiners 20 and 21 to the ring 19 and attach the rings 18 and 23 to the first exercise accessory and the second exercise accessory, respectively, using two separate carabiners. Furthermore to approximately double the resistance of the linked stretch tube 10 over only half the one half length of the linked stretch tube 10 with the carabiner 20 attached to the first exercise accessory and the ring 19 attached to the second exercise accessory using a separate carabiner, the ring 23 may be attached to the ring 18 using the carabiner 21 or a separate carabiner.

With the desired usable or effective length of the linked stretch tube 10 equal to about three quarters of the length of the linked stretch tube 10, the resistance of the linked stretch tube 10 may be adjusted to one additional resistance. To approximately double the resistance of the linked stretch tube 10 over approximately a third of the three quarters length of the linked stretch tube 10 with the carabiner 20 attached to the first exercise accessory and the ring 23 attached to the second exercise accessory using a separate carabiner, the carabiner 21 may be attached to the ring 19.

Each linking device 14, 15, and 17 may be constructed identically and may be located between two stretch tubing sections 12 of the linked stretch tube 10 as shown in FIG. 1. The linking device 14 may include a pair of anchors 22, a nylon band loop 24, and a metal ring 18. Each anchor 22 may include a loop end 26 and a shank end 28. The shank end 28 of each anchor 22 may be inserted into an end of one of the tubing sections 12 and may be held in place by the compression of the tubing section 12. The two loop ends 26 may be connected together with a nylon band loop 24. The metal ring 18 may be an O-ring or a D-ring and may be included within the linked nylon band loop 24. The nylon band loop 24 may be stitched together adjacent the loop ends 26 of each anchor 22 and the metal ring 18 to prevent the loop ends 26 and the metal ring 18 from sliding across the nylon band loop 24. Linking devices 15 and 17 may be similarly constructed with rings 19 and 23, respectively. Thus, each linking device such as device 14 includes a pair of anchors 22. Each anchor 22 includes a loop end 22 linked with the fabric band loop 18, and a shank 28 being cylindrical throughout its axial length terminating in a flat distal end. The shank 28 is disposed within the end of one of the stretch tubing sections 12 and is fixed in place by compression. The ring 18 linking with the fabric band loop 18 is disposed between the pair of anchors 22 also linking with the loop 18.

Each connecting device 16 and 25 may be constructed identically and may be located at an end of the stretch tubing section 12 at an end of the linked stretch tube 10 as shown in FIG. 1. The connecting device 16 may include an anchor 22, a nylon band loop 30, and a fastener or carabiner 20. The anchor 22 may include a loop end 26 and a shank end 28. The shank end 28 of the anchor 22 may be inserted into the end of the stretch tubing section 12 and may be held in place by the compression of stretch tubing section 12. The carabiner 20 may be connected to the loop end 26 of anchor 22 with the nylon band loop 30. The nylon band loop 30 may be stitched adjacent the carabiner 20 and the loop end 26 to prevent the carabiner 20 and the loop end 26 from sliding across the nylon band loop 30. The connecting device 25 may be similarly constructed with carabiner 21.

Referring now to FIG. 3, an exercise system for performing squats, toe raises/extenders, or other exercises utilizing the linked stretch tubes is shown. The exercise system 40 may include a waist harness 42, a pair of foot harnesses 44, and a pair of linked stretch tubes 10 connected between the waist harness 42 and the foot harnesses 44.

The waist harness 42 may include a belt 48 having a buckle 50 or some other coupling device at the front, a pair of leg loops 52, and three metal rings 54, 56, and 58. Each leg loop 52 may encircle one of the legs of the user and may prevent the waist harness 42 from rotating around the waist of the user. Two of the metal rings 54, 56 may be attached to the belt 48 so as to be located at the left and the right side of the user, respectively, and may be used in this application for connection of the linked stretch tubes 10. A third metal ring 58 may be attached to the belt so as to be located at the back of the user for performing other exercises. The metal rings may be O-rings or D-rings. Carabiners 59 and 61 may be attached to some or all of the metal rings for attachment of the linked stretch tubes.

Each foot harness 44 may include a band 60 for encircling the foot or ankle of the user and a metal ring 62 for attachment of the linked stretch tube 10. The band 60 may include a fastening device when wrapping the band 60 around the foot or ankle of the user. Each foot harness 44 may also include a carabiner (not shown) for attaching one or more of the rings of the linked stretch tube.

The linked stretch tubes 10 may be selected and attached to the waist harness 42 and the foot harnesses 44 in this application depending on the height of the user and the desired resistance of the user. In FIG. 3 the carabiners 20, 21 of each of the linked stretch tubes 10 may be attached to the metal ring 62 of each foot harness and the ring 19 of each of the linked stretch tubes may be attached to one of the metal rings 54 or 56 on the waist harness 42 using carabiners 59 and 61, respectively.

In FIG. 4 a linked stretch tube is shown attached to a door utilizing a door mount. The door mount 70 may include a strap 72 which vertically wraps entirely around a door 74, a buckle 76 or some other coupling device, and a plurality of connection points 78 for attaching a linked stretch tube 10. As shown in FIG. 4A, the ring 18 of the linked stretch tube 10 may be attached to the connection point 78 of strap 72 using the carabiner 21. The linked stretch tube 10 may also be connected using carabiner 20 to a foot harness 44 attached to the ankle of a user. Other exercises may be performed using the door mount 70 by utilizing different exercise accessories, attaching the linked stretch tube 10 differently or at different connection points 78, and/or utilizing additional linked stretch tubes 10 and/or linked stretch tubes 10 having different resistance levels. One or more additional carabiners (not shown) may be utilized to attach one or more rings of a linked stretch tube to the connection points of the door mount.

In FIG. 5 a linked stretch tube is shown attached to a wall utilizing a wall mount. The wall mount 80 may include a strip 82 attached to a wall 84 using screws 86 or other attachment devices and a plurality of connection points 88 for attaching a linked stretch tube 10. The linked stretch tube 10 may also be connected to a handle 90 adapted to be grasped by a hand of a user. The handle 90 may include a metal ring 92 for attaching the linked stretch tube 10. Similar exercises as performed using the door mount may be performed using the wall mount 80 by utilizing different exercise accessories, attaching the linked stretch tube 10 differently or at different connection points 88, and/or utilizing additional linked stretch tubes 10 and/or linked stretch tubes 10 having different resistance levels. One or more additional carabiners (not shown) may be utilized to attach one or more rings of a linked stretch tube to the connection points of the wall mount.

Figure 6:
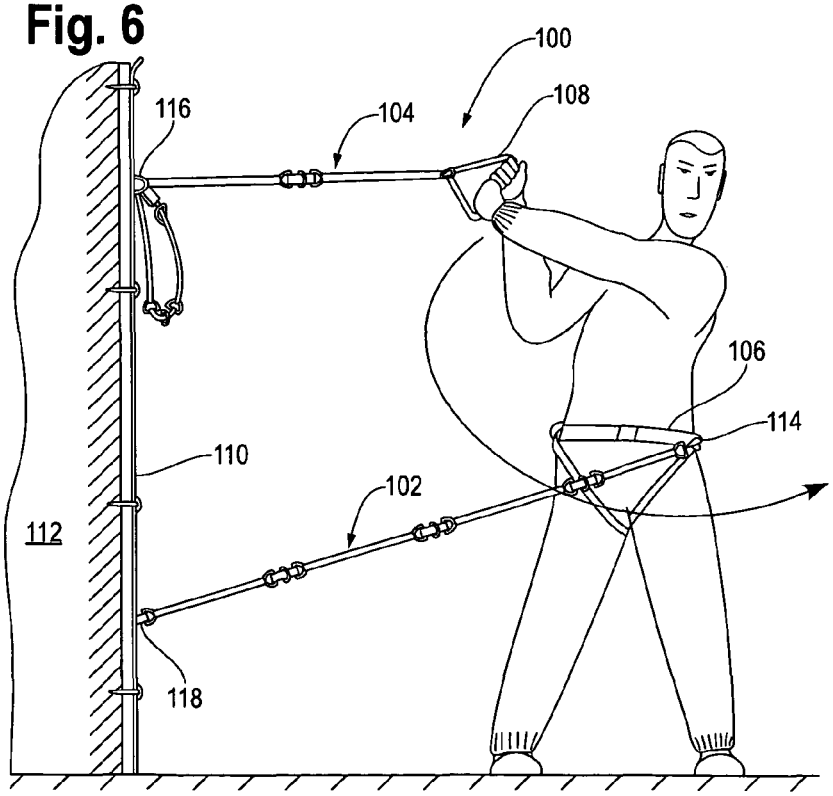
FIG. 6 is a perspective view of a golf conditioning system using linked stretch tubing.

Referring now to FIG. 6, a golf conditioning system is shown. The golf conditioning system 100 may include a pair of linked stretch tubes 102 and 104, a waist harness 106, a handle 108, and a wall mount 110 attached to a wall 112. A user wearing the waist harness 106 may be positioned with his dominant arm closest to the wall mount 110, i.e. a right-handed golfer stands with his right arm nearer the wall mount 110 and a left-handed golfer stands with his left arm nearer the wall mount 110.

The user in FIG. 6, a right-handed golfer, may attach the linked stretch tube 102 to a metal ring 114 on the waist harness 106 on the left side of his body and to the wall mount 112 at a connection point 116 approximately one to two feet above the floor to provide resistance to the twisting motion of the user's lower body. The other linked stretch tube 104 may be attached to the handle 108 held by the user in either his left hand or both hands and attached to the wall mount 110 at a connection point 118 at a height above the user's head to provide resistance to the user when swinging the handle 108 as the user would a golf club. The length of each linked stretch tube may be varied due to the distance from the wall and the resistance desired by the user. As shown in FIG. 8, the user may be using the full length of the linked stretch tube 102 and only one half of the length of the linked stretch tube 104.

In the golf conditioning system 100, a door mount may be used in place of the wall mount 110 and the handle 108 may be replaced by a device that more closely resembles the grip of a golf club. Furthermore, the user may attach only one linked stretch tube at a time to exercise each part of the body separately.

Other sports requiring a swinging motion may also utilize a similar system, such as tennis, baseball, racquetball, handball, etc.

Due to the versatility of the linked stretch tubes, a portable exercise kit enabling a user to perform a total workout may include approximately ten linked stretch tubes (a pair of linked stretch tubes for approximately five different resistance levels), a waist harness, a pair of foot harnesses, a pair of handles, and a door mount. All of this equipment may be placed in a small canvas bag (not shown) or other suitable container for allowing the user to take his gym equipment with him or her, and to never miss a workout.

It is envisioned that the linked stretch tubes may be utilized in other applications that stretch cords may be used in, such as for securing items on the top of a vehicle or in the back of a truck or van. When the word "about", "substantially," or the like is used in the specification and/or claims herein, it shall be defined as plus or minus 20 percent.

While particular embodiments of the present invention have been disclosed, it is to be understood that various different embodiments are possible and are contemplated within the true spirit and scope of the appended claims. For example, the tubing may be constructed and composed of a variety of different stretchable materials and may be solid throughout its axial length. Also, for example, the linked stretch tube may be anchored to any suitable stationary structure, such as a wall, a door, a piece of exercise equipment or other. There is no intention, therefore, of limitations to the exact abstract or disclosure herein presented.

What is claimed is:

1. An exercising kit, comprising:

a group of fasteners;

a group of linking devices;

each linking device including a fabric band loop;

each linking device further including a single ring fixed to the band loop;

a first linked stretch tube device having a series of like thickness individual stretch tubes interconnected end to end by a plurality of the linking devices and having a pair of the fasteners attached to opposite ends of the interconnected tubes to enable at least one of the fasteners to be attached releasably to one of the rings of the linking devices between adjacent tubes to enable at least two of the tubes to overlap to adjust the usable length and resistance of the tube device;

a second linked stretch tube device having a series of like thickness individual stretch tubes interconnected end to end by a plurality of the linking devices and having a pair of the fasteners attached to opposite ends of the interconnected tubes to enable at least one of the fasteners to be attached releasably to one of the rings of the linking devices of the second linked stretch tube device between adjacent tubes to enable at least two of the tubes of the second linked stretch tube device to overlap to adjust the usable length and resistance;

each one of the stretch tubes having substantially the same length and substantially the same thickness;

each linking device connecting fixedly a pair of adjacent stretch tubes ends;

each linking device including a pair of anchors, a first one of the anchor having a first loop end linking with the fabric band loop and having a first shank being cylindrical throughout its axial length terminating in a substantially flat distal end and being inserted within the end of one of the stretch tubes fixed in place by compression, a second one of the anchors having a second loop end linking with the fabric band loop and having a second shank being cylindrical throughout its axial length terminating in a substantially flat distal end and being inserted within the end of another one of the stretch tubes fixed in place by compression, the ring linking with the fabric band being disposed between the first and second loop ends to facilitate the adjusting the length and/or the resistance of its linking device;

a waist harness adapted to attach to the first linked stretch tube device;

an elongated handle adapted to attach to the second linked stretch tube device and adapted to be grasped by one or more hands of the user to execute a swinging motion with it;

a pair of vertically aligned, spaced apart first and second fixed connectors adapted to be fixedly mounted for receiving releasably at least one of the fasteners;

the first connector for the first linked stretch tube device being disposed at a height of between about one foot and about two feet above an exercising surface to allow the first linked stretch tube device to provide resistance to the twisting motion of the user's lower body as the user performs a swinging motion;

the second connector for the second linked stretch tube device being disposed at a height substantially greater than the height of the first connection point for the first linked stretch tube device to allow the second linked stretch tube device to provide resistance as the handle is manually grasped by the user and moved along a swinging path of travel;

the usable length of the first linked stretch tube device being substantially greater than the usable length of the second linked stretch tube device during use;

the handle showing the appearance of a grip of a piece of sports equipment; and the length and resistance of the linked stretch tube devices being adjustable to enable the user to progress in an exercise program by releasably connecting to one of the fasteners between adjacent tubes of at least one of the linked stretch tube devices.

2. The kit of claim 1, wherein the first and second fixed connectors comprise a door mount adapted to be mounted to a door and adapted to receive the linked stretch tube devices.

3. The kit of claim 1, wherein the first and second fixed connectors comprise a wall mount adapted to be mounted to a wall and are adapted to receive the linked stretch tube devices.

4. The kit of claim 1, wherein the waist harness includes a belt for encircling a user's waist, a first loop attached to the belt and encircling one of the user's legs, and a second loop attached to the belt and encircling the other of the user's legs.

5. The kit of claim 1, wherein the waist harness includes a belt for encircling a users waist and at least three rings attached to the belt.

6. The kit of claim 5, wherein the waist harness includes a carabiner attached to at least one of the three rings.

7. The kit of claim 2, wherein the door mount includes more than two connectors adapted for attaching the linked stretch tube devices.

8. The kit of claim 3, wherein the wall mount includes more than two connectors adapted for attaching the linked stretch tube devices.

* * * * *

UNITED STATES PATENT AND TRADEMARK OFFICE

CERTIFICATE OF CORRECTION

PATENT NO. : 7,727,131 B2
APPLICATION NO. : 11/372519
DATED : June 1, 2010
INVENTOR(S) : Brett J. Longo It is certified that error appears in the above-identified patent and that said Letters Patent is hereby corrected as shown below:

Claim 5, column 8, line 43, delete "users" and insert -- user's --

Signed and Sealed this

Twenty-seventh Day of July, 2010

David J. Kappos

David J. Kappos
*Director of the United States Patent and Trademark Office*